US011000106B2

(12) United States Patent
Vacheron

(10) Patent No.: US 11,000,106 B2
(45) Date of Patent: May 11, 2021

(54) ROTATING MECHANISM OF A COSMETIC CASE

(71) Applicant: REBOUL S.A.S., Chavanod (FR)

(72) Inventor: Frederic Vacheron, Menthon Saint Bernard (FR)

(73) Assignee: REBOUL S.A.S.

( * ) Notice: Subject to any disclaimer, the term of this patent is extended or adjusted under 35 U.S.C. 154(b) by 101 days.

(21) Appl. No.: 16/097,261

(22) PCT Filed: Apr. 25, 2017

(86) PCT No.: PCT/FR2017/050980

§ 371 (c)(1),
(2) Date: Apr. 8, 2019

(87) PCT Pub. No.: WO2017/187083

PCT Pub. Date: Nov. 2, 2017

(65) Prior Publication Data

US 2019/0216203 A1 Jul. 18, 2019

(30) Foreign Application Priority Data

Apr. 28, 2016 (FR) ..... 1670200

(51) Int. Cl.
*A45D 40/06* (2006.01)
*A45D 40/04* (2006.01)
(Continued)

(52) U.S. Cl.
CPC ..... *A45D 40/06* (2013.01); *A45D 40/04* (2013.01); *A45D 2040/0062* (2013.01); *A45D 2040/208* (2013.01)

(58) Field of Classification Search
CPC ..... A45D 40/00; A45D 40/02; A45D 40/04; A45D 40/20; A45D 40/205;
(Continued)

(56) References Cited

U.S. PATENT DOCUMENTS 3,817,636 A 6/1974 Ritzenhoff
4,770,556 A * 9/1988 Ackermann ..... A45D 40/04 401/69
(Continued)

FOREIGN PATENT DOCUMENTS

DE 10 2010 031 803 A1 1/2012
FR 2 198 713 4/1974
FR 2 955 469 A1 7/2011

OTHER PUBLICATIONS

International Search Report (with English translation) dated Aug. 16, 2017 for International application No. PCT/FR2017/050980.
(Continued)

*Primary Examiner* — David J Walczak
(74) *Attorney, Agent, or Firm* — Fay Sharpe LLP

(57) ABSTRACT

A rotating mechanism for a cosmetic case includes a slider (2) that is equipped with two studs, each of which crosses a helicoidal opening (6) of a spiral casing (3) that is pressed onto the slider (2). The studs each extend into a longitudinal port that is arranged inside an exterior sleeve (4) and that is pressed onto the spiral casing (3). The slider (2) includes two parts, namely an upper end including a cradle (13) designed to receive a cosmetic product, and an elongated cylindrical portion (14) in which the studs at its lower end are arranged.

20 Claims, 7 Drawing Sheets

(51) Int. Cl.
*A45D 40/00* (2006.01)
*A45D 40/20* (2006.01)

(58) Field of Classification Search
CPC ..... A45D 2040/00; A45D 2040/0025; A45D 2040/20; A45D 2040/205; A45D 2040/208; B65D 83/0005
USPC ..... 401/68, 75–78, 171–175
See application file for complete search history.

(56) References Cited

U.S. PATENT DOCUMENTS 5,597,252 A 1/1997 Ito et al.
5,902,062 A * 5/1999 Rosenblatt ..... A45D 40/06 401/68
6,004,054 A * 12/1999 Wei-Pin ..... A45D 40/06 401/78
6,231,254 B1 * 5/2001 Holloway ..... A45D 40/04 132/318
8,591,129 B2 * 11/2013 Chan ..... A45D 40/023 401/107

OTHER PUBLICATIONS

Written Opinion of the International Searching Authority (with English translation) dated Aug. 16, 2017 for International application No. PCT/FR2017/050980.
International Preliminary Report on Patentability (with English translation) dated Oct. 30, 2018 for International Application No. PCT/FR2017/050980.

* cited by examiner

ROTATING MECHANISM OF A COSMETIC CASE

CROSS-REFERENCE TO RELATED APPLICATION

This application is the U.S. National Phase of PCT International Application No. PCT/FR2017/050980 filed Apr. 25, 2017, which claims priority from French Application No. 1670200 filed Apr. 28, 2016.

FIELD

The present invention concerns a rotating mechanism for a cosmetic case, more specifically a lipstick wand.

BACKGROUND

Generally, as revealed by documents FR 2 955 469 and U.S. Pat. No. 5,597,252, a rotating mechanism consists of a slider equipped with studs encased inside an interior sheath that is equipped with two longitudinal ports, and which is itself encased inside an outer enclosure comprising two helicoidal grooves. The slider's studs cross the ports of the interior sheath and extend into the helicoidal grooves of the exterior casing. The rotating mechanism is connected by the outer casing to a packaging component below. The slider, which is equipped with a stick made of cosmetic product, such as a stick of lipstick or lip cream, is subjected to an axial translation movement, through the rotation of the assembly formed by the spiral casing and the upper packaging. A closing cap is pressed onto the upper end of the rotating mechanism, corresponding to the lower packaging component, so that it hermetically seals the cosmetic case made in this way.

A stick of lipstick or lip cream is, in general, cast by the bottom of the cosmetic case or molded beforehand and mounted into the slider.

The lower packaging and the mechanism are in general fitted in such a way as to require a specific assembly, which cannot be carried out by the final packager of the lipstick stick. For this purpose, the rotating mechanism is preassembled to the lower packaging component by the mechanism's distributor.

The lower packaging component comprises a filling orifice, as revealed by document U.S. Pat. No. 5,597,252, which, after the lipstick stick has been cast, is obstructed by an appropriate cover. However, an error in placement or in casting the lipstick stick, makes both the mechanism and the lower packaging component unusable, and they must then be discarded.

The upper end of the rotating mechanism in document FR 2 955 469, upon contact with the lips of the user, through which the stick of cosmetic product comes out, is beveled, and is mounted on a part that is arranged in the center of the mechanism. This part is the interior sheath inside which the slider is guided. The cylindrical profile of the interior sheath is not constant, namely, it consists of two cylindrical parts having two different diameters. In the case of an interior sheath of metallic material, the upper end of these rotating mechanisms, therefore comprise sharp-edged parts, which may irritate the lips of the user. These sharp-edged parts cannot be rounded by a stamping process.

SUMMARY

The present invention thus proposes an improvement in the rotating mechanism of a cosmetic case, one that remedies the abovementioned drawbacks.

In this way, the rotating mechanism of a cosmetic case, according to the invention, consists of a slider equipped with two studs, each of which crosses a helicoidal opening of a spiral casing inserted into the slider, whereas the studs each extend into a longitudinal port arranged inside an exterior sleeve that is pressed onto the spiral casing.

We should add here that the spiral casing consists of a cylindrical body part in which the two helicoidal openings are arranged, whereas the cylindrical body part is lengthened by a crown.

We note here that the exterior sleeve comprises an internal peripheral rib that fits inside a peripheral groove that is arranged inside the spiral casing.

We specify here that the peripheral groove is located below the lower ends of the helicoidal openings arranged inside the cylindrical body part of the spiral casing.

According to one manner of embodiment, the studs are movable at least transversally.

According to one characteristic, the lower end of the cylindrical body part of the spiral casing comprises at least one flexible slat that extends outwards.

According to one manner of embodiment, the slider consists of two parts, namely an upper end comprising a cradle that is designed to receive a cosmetic product, and an elongated cylindrical portion in which the studs are arranged at its lower end.

According to the preceding manner of embodiment, the outer diameter of the extended cylindrical portion is more or less equal to the interior diameter of the spiral casing, whereas the outer diameter of the cradle is more or less equal to the interior diameter of the exterior sleeve.

According to one additional characteristic, the upper part of the crown comprises a peripheral stop ring that limits the deflection of the pressing of the exterior sleeve.

According to one preferred manner of embodiment, the rotating mechanism is comprised of three body parts, namely the slider, the spiral casing and the exterior sleeve.

According to one manner of execution, the spiral casing comprises an upper groove assembled with an upper rib that is arranged inside the exterior sleeve.

BRIEF DESCRIPTION OF THE DRAWINGS

Other characteristics and advantages of the invention will become apparent from the description that will follow and from the attached drawings, which are given only as non-limiting examples.

FIG. 1 is a front view and partial section view, of the mechanism comprising an exterior sleeve, a spiral casing and a slider.

FIG. 2 is an enlargement of the section view from FIG. 1.

FIG. 3 is a section view of FIG. 1 along line A-A, with the slider in the lower position.

FIG. 4 is a section view of FIG. 1 along line A-A, with the slider in the upper position.

FIG. 5 is a front view of a slider that is adapted for the casting of a stick of cosmetic product.

FIG. 6 is a section view of FIG. 5 along line A-A.

FIG. 7 is a front view of an exterior sleeve.

FIG. 8 is a section view of FIG. 7 along line A-A.

FIG. 9 is a front view of a spiral casing.

FIG. 10 is a section view along line A-A of a spiral casing.

FIG. 11 is an enlargement of FIG. 10.

Figure 14:
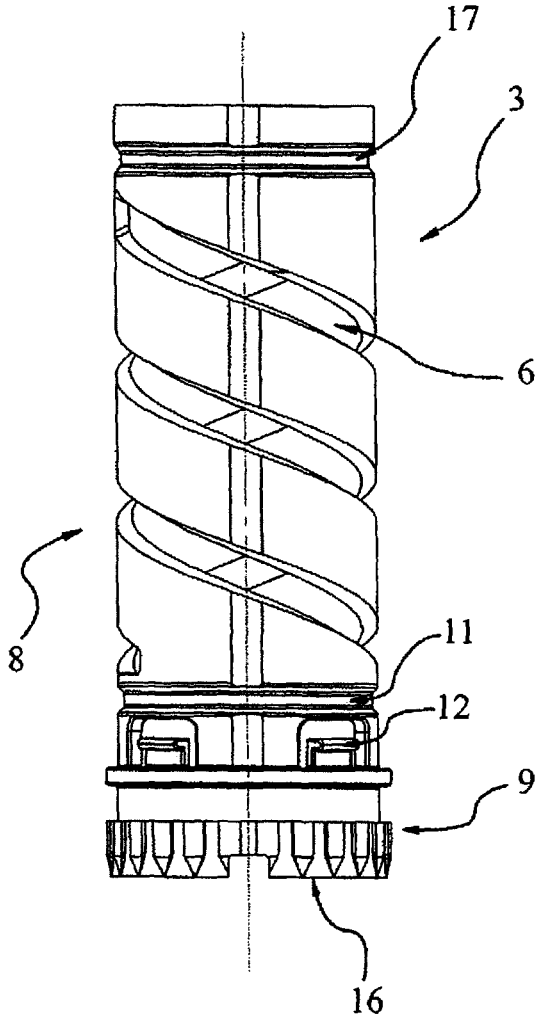
Figure 15:
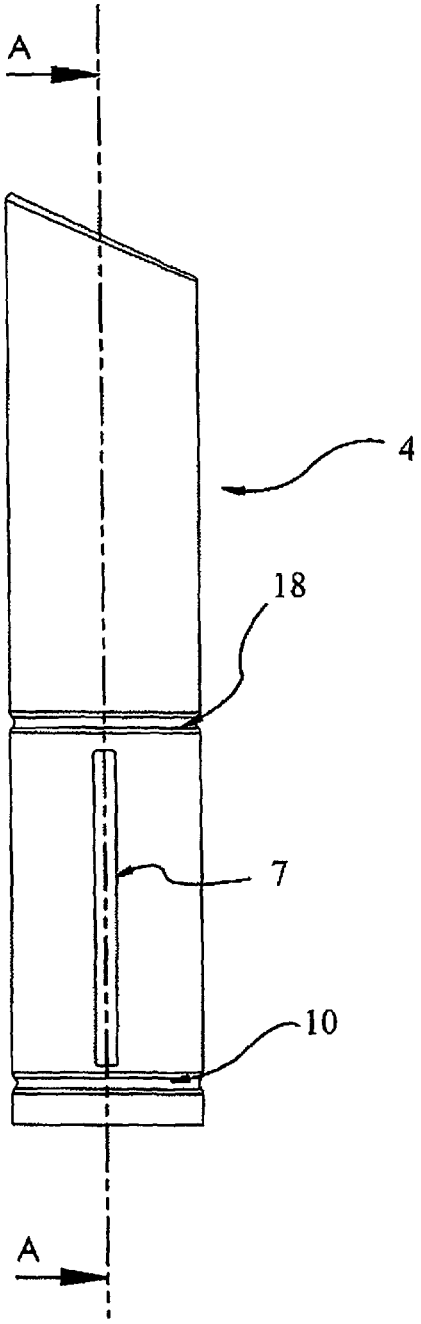

The FIGS. 14 and 15 are, respectively, views of a spiral casing and of an exterior sleeve, according to one manner of execution of the invention.

FIG. 14 is a front view of a spiral casing.

FIG. 15 is a front view of an exterior sleeve.

DETAILED DESCRIPTION

In this way, rotating mechanism (1), according to the invention, is adapted to a lipstick wand and comprises three body parts, which are assembled inside each other. The rotating mechanism (1) is comprised of a slider (2), a spiral casing (3) and an exterior sleeve (4).

The term "exterior sleeve" (4), shall be understood to mean the body part in contact with at least one upper packaging component, such as a removable closing cap, as will be elaborated in greater detail in the rest of the description.

Slider (2) and spiral casing (3) are preferentially made of synthetic material, whereas exterior sleeve (4) is preferentially made of metallic material.

In the rest of the description, it should be understood that the rotating mechanism (1) is in the user position, namely the upper end of the rotating mechanism (1) directed upwards, as illustrated in FIGS. 1 through 13.

It is likewise understood that an axial position corresponds to a longitudinal position that is directed from top to bottom, and the term "transversal position" shall be taken to mean a position that is perpendicular to the axis that passes through the upper end and the lower end of rotating mechanism (1).

For information purposes, we shall call a lipstick wand a cosmetic case, which generally has a lower diameter and a greater length, than a standard tube of lipstick or lip cream. Thus, the slider has a longer length than that of a standard cosmetic case.

This rotating mechanism (1) is associated with a lower packaging component and an upper packaging component, namely a base at its lower end, corresponding to a removable closing cap that is pressed onto the free upper end of the rotating mechanism (1) and is placed in the closed position positioned around exterior sleeve (4) so as to completely and hermetically close the cosmetic case, but this could be done otherwise, with the closing cap being applied indirectly around the exterior sleeve (4), via an annular rib arranged peripherally below this latter.

These three body parts have profiles that are generally cylindrical, adapted such that slider (2) is encased inside spiral casing (3), whereas exterior sleeve (4) is pressed onto this latter.

In general, slider (2) comprises two studs (5) that are arranged opposite each other and which each fit into a helicoidal opening (6) in spiral casing (3), whereas each of them extends into a longitudinal port (7) arranged inside exterior sleeve (4), as was explained in greater detail in the rest of the description.

Slider (2) appears, at its upper end, as a cradle (13), also called a cup, that is designed to accommodate a cosmetic product, which is lengthened by an elongated cylindrical portion (14), of a smaller diameter, on which are arranged studs (5) more or less at its lower end.

Cradle (13) is for example equipped with fins that are arranged radially relative to the vertical wall of cradle (13). These fins help to keep the cosmetic product stick in place.

Figure 3:
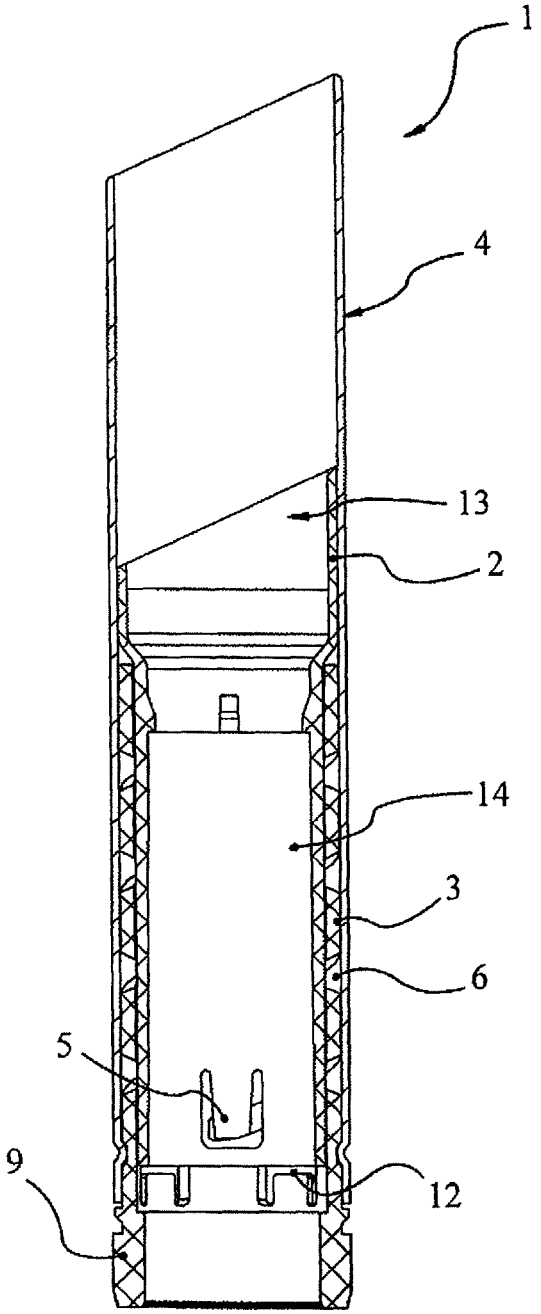
Figure 4:
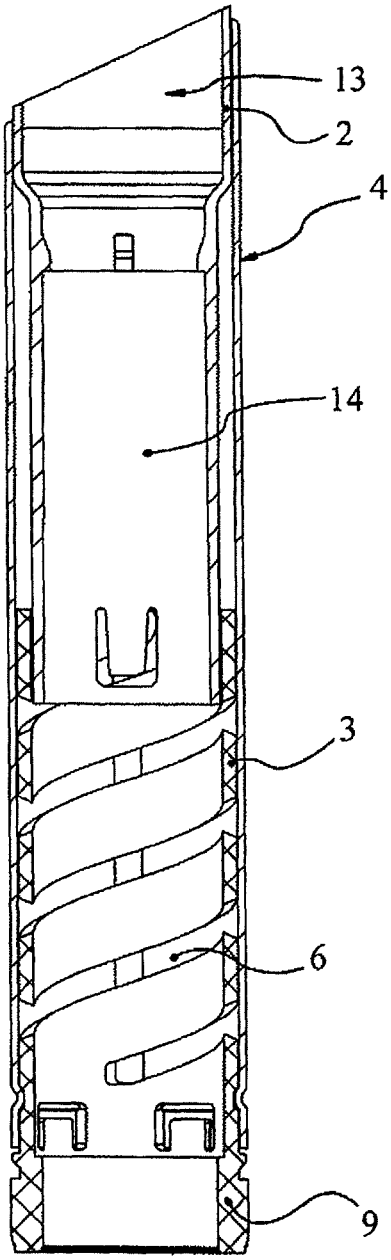
Figure 5:
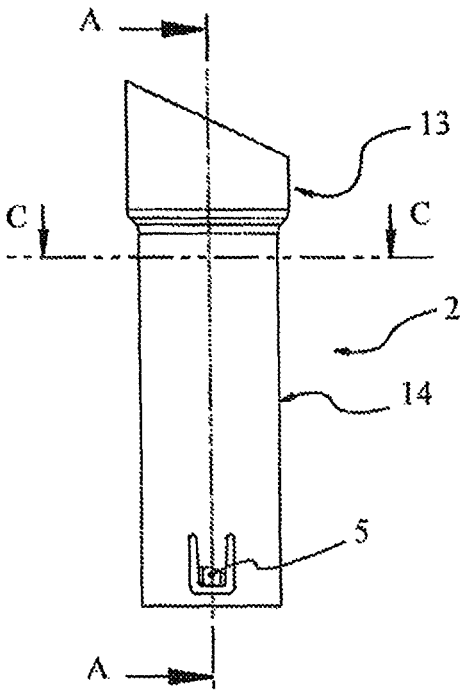

The outer diameter of cradle (13) corresponds more or less to the interior diameter of exterior sleeve (4), whereas the outer diameter of the elongated cylindrical portion (14), corresponds more or less to the interior diameter of spiral casing (3), as illustrated in FIGS. 3 and 4.

We have understood that the outer diameter of spiral casing (3) corresponds to the interior diameter of exterior sleeve (4) and which is therefore more or less equal to the outer diameter of cradle (13).

We note here that studs (5) on slider (2) are mounted on flexible brackets. Thus, studs (5) are flexible at least transversally, namely they are engaged inside the helicoidal openings (6) in spiral casing (3), whereas they come into play in the longitudinal ports (7) of exterior sleeve (4).

We should point out here that these studs (5), as illustrated in FIGS. 5, 6, 12 and 13, appear as lateral projections, relative to the body of the elongated cylindrical part (14). The flexible brackets are held on the wall of slider (2) by their upper extremities, whereas lateral cutouts and a lower cutout border the flexible brackets, which offers the studs (5) a flexibility that is at least transversal, namely at least a radial flexibility.

We add here that spiral casing (3) comprises two helicoidal openings (6) that open out towards its upper end, in the cylindrical wall of its body piece (8).

In this way, helicoidal openings (6) of spiral casing (3) offer a certain longitudinal flexibility to this latter, which, at the end of the stroke of slider (2), when the cosmetic product is at the end of its life, causes a spring effect of slider (2) due to the flexibility of spiral casing (3).

In order to remedy this drawback, according to one manner of execution of the invention, spiral casing (3) is equipped with an upper groove (17) advantageously peripheral, more precisely partially peripheral, at its upper end, more precisely at the upper ends of helicoidal openings (6), as illustrated in FIG. 14.

The term "partially peripheral upper groove" (17) should be taken to mean a peripheral groove in which the upper openings are arranged that discharge out onto helicoidal openings (6).

In correspondence with this upper groove (17), an upper rib (18) that is preferentially peripheral, is arranged inside exterior sleeve (4), in such manner as to make it project into the inside of the section of exterior sleeve (4).

According to the manner of embodiment illustrated in FIG. 15, upper rib (18) is peripheral, namely projecting over the entirety of the interior perimeter of the outline of exterior sleeve (4).

It should be understood that upper rib (18) is located above longitudinal ports (7), as illustrated in FIG. 15.

We should point out here that the assembly of the upper rib (18) and the upper groove (17) makes it possible for the spiral casing (3) to work together in longitudinal translation with the exterior sleeve (4), eliminating the spring effect of slider (2) at the end of the stroke, when the cosmetic product is being applied at the end of its life.

Figure 1:
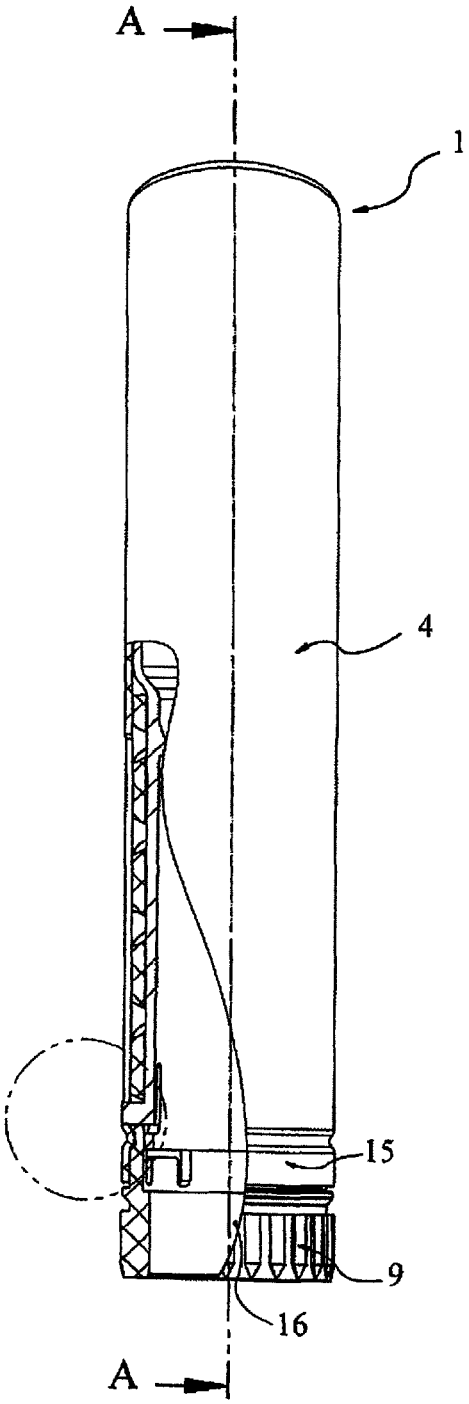
FIGS. 1 through 11 are views of a mechanism of a cosmetic case according to one manner of embodiment of the invention.
Figure 2:
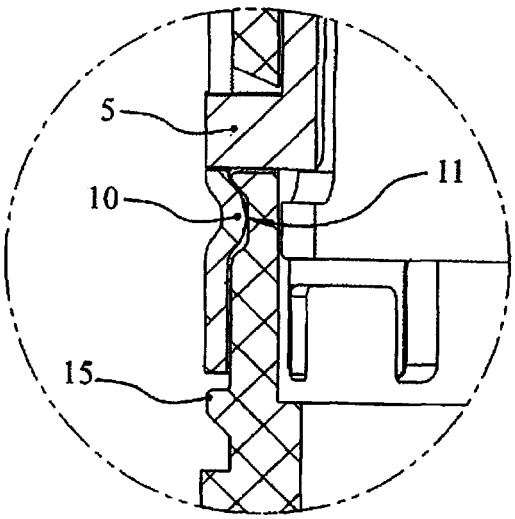

We note here that the lower part of cylindrical body part (8) of the spiral casing (3), below the lower ends of the helicoidal openings (6), comprises a peripheral groove (11), that engages with an interior peripheral rib (10) that is arranged inside the lower part of the interior wall of exterior sleeve (4), as illustrated in FIG. 2 and as was explained in greater detail in the rest of the description.

The fit of this peripheral groove (11) with the interior peripheral rib (10) of exterior sleeve (4), makes it possible not only to hold these two body parts in position, but also to participate in the rotation of these two parts relative to each other.

According to one characteristic, the lower part of cylindrical body part (8) of spiral casing (3), below the lower ends of helicoidal openings (6), likewise advantageously below peripheral groove (11), comprises at least one flexible slat (12), advantageously multiple flexible slats (12), preferably four flexible slats (12), that are distributed regularly along the circumference of spiral casing (3).

According to the manner of embodiment illustrated, peripheral groove (11) is more precisely sequentially peripheral, namely in that it comprises portions of peripheral concentric grooves, into which the ends of flexible slats (12) position themselves.

A flexible slat (12) extends more or less towards the exterior beyond the general outline of spiral casing (3) and appears according to the manner of embodiment illustrated as at least one lateral projection, one that is attached to cylindrical body part (8) by its lower end, whereas it partially detaches itself from cylindrical body part (8) through lateral cutouts and an upper cutout.

According to the previous characteristic, when exterior sleeve (4) is fitted onto spiral casing (3), at least one flexible slat (12) is in contact with the interior wall of exterior sleeve (4), and compresses slightly inwards.

We should point out here that these flexible slats (12), absorb the radial play between exterior sleeve (4) and spiral casing (3), [and] control the couple, and thus slow down the rotation of the assembly consisting of spiral casing (3) and exterior sleeve (4), affording comfort of use.

According to the manner of embodiment illustrated, the cylindrical body part (8) of spiral casing (3) is elongated towards its lower end by a crown (9).

We should add here that according to the manner of embodiment illustrated here, the spiral casing (3) and the crown (9) are an integral part of the same body part.

We should note here that the upper part of crown (9) comprises a peripheral stop ring (15), located below peripheral groove (11). This peripheral stop ring (15) has the major role of limiting deflection downwards, when the exterior sleeve (4) is being fitted onto spiral casing (3), and, during the assembly process, of the peripheral groove (11) with the interior peripheral rib (10).

We should point out here that peripheral stop ring (15) is not in contact with the lower end of exterior sleeve (4), when it is in the assembled position.

According to one additional characteristic, the exterior surface of crown (9) features grooves (16) that are equidistant and regularly spaced. Since crown (9) is fitted inside a lower packaging component, namely a base, as was explained previously, grooves (16) contribute to keeping crown (9) under pressure inside the base.

As was specified previously, exterior sleeve (4) comprises two longitudinal ports (7) that are arranged opposite each other, in its cylindrical wall, inside which are fitted the studs (5) from slider (2).

While the user is holding exterior sleeve (4), the spiral casing (3), makes it possible to drive the slider (2) in axial translation, during axial rotation of the assembly consisting of crown (9) and spiral casing (3).

Longitudinal ports (7) are of a length that corresponds to the height of the cylindrical body part (8) of spiral casing (3), whereas the body of the elongated cylindrical portion (14) of slider (2) has a length that is more or less equal to that of the cylindrical body part (8) of spiral casing (3).

We should point out here that the ends of longitudinal ports (7) coincide more or less with those of helicoidal openings (6).

In this way, by the specific structure of rotating mechanism (1) according to the invention, the height of cylindrical body part (8) of spiral casing (3) is more or less equal to, or even greater, than half of that of exterior sleeve (4).

Figure 6:
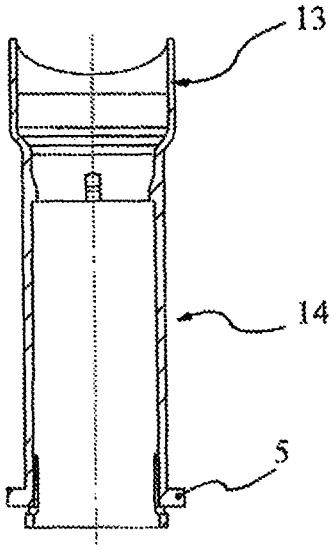
Figure 5A:
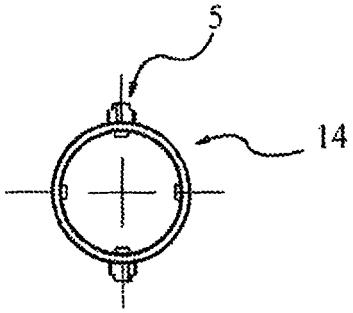
FIG. 5*a* is a section view along line C-C of FIG. 5.
Figure 7:
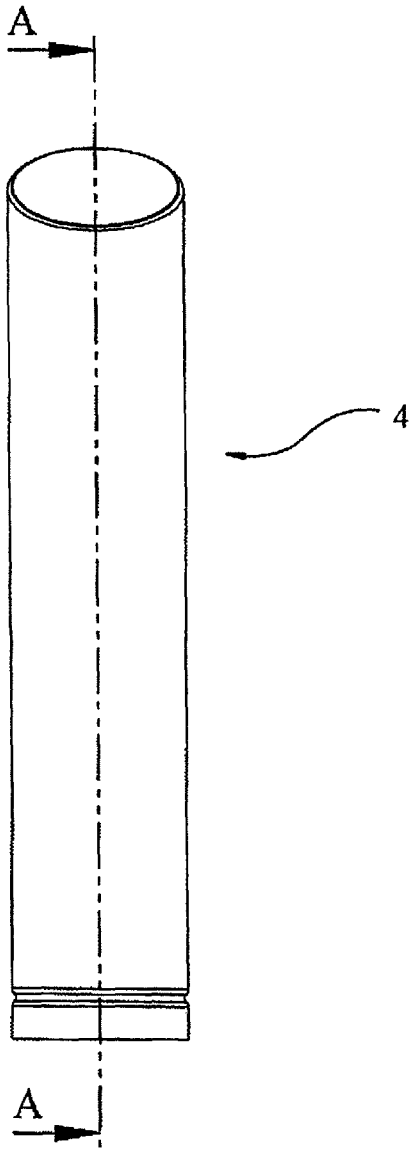
Figure 8:
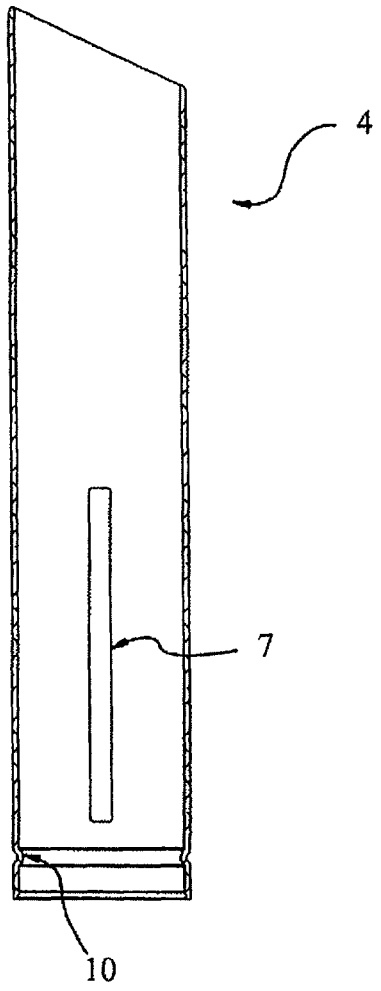
Figure 9:
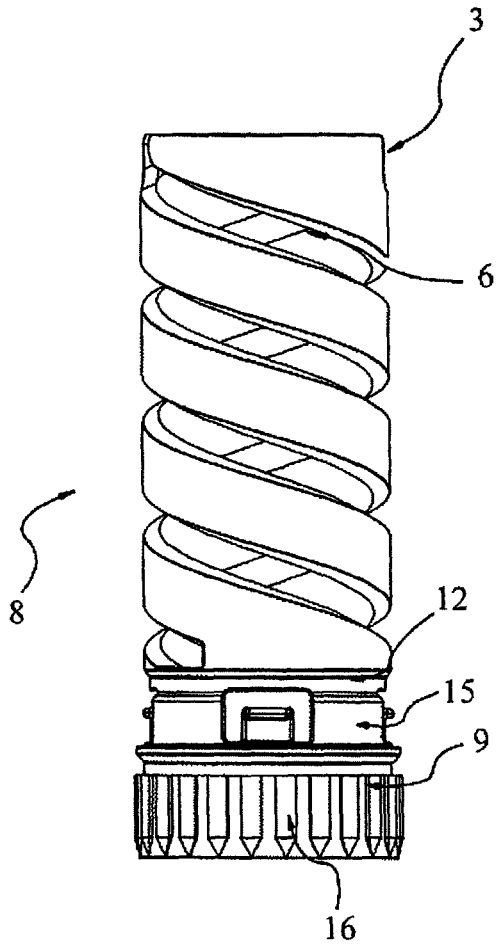
Figure 10:
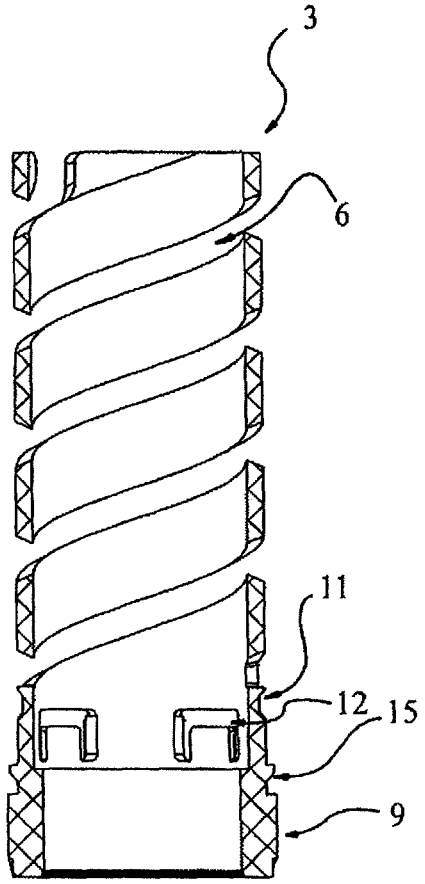
Figure 11:
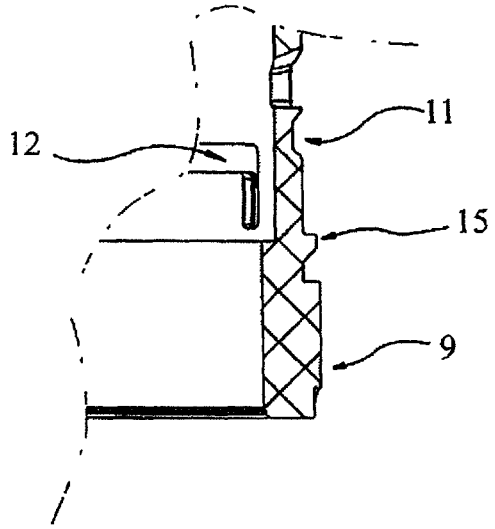

According to the manner of embodiment illustrated in FIG. 6, the specific structure of slider (2) enables the latter to be filled, by casting of a stick of lipstick through the lower part of slider (2), which comprises an appropriate orifice.

This particularity makes it possible to cast the lipstick stick prior to assembly of the lower packaging component, namely the base. This particularity has the advantage, when a filling error occurs, of not making it necessary to throw away the lower packaging component along with rotating mechanism (1).

According to one complementary characteristic, the lower packaging component, namely the base, does not advantageously have a filling orifice, one that is obscured by an appropriate cover, which improves the esthetics of the cosmetic case.

Figure 12:
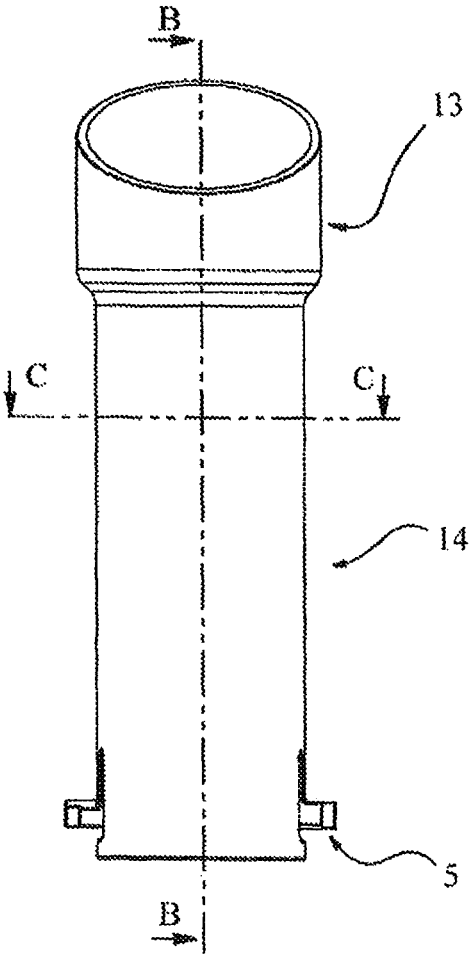
FIG. 12 is a front view of a slider intended to clamp a stick of cosmetic product.
Figure 13:
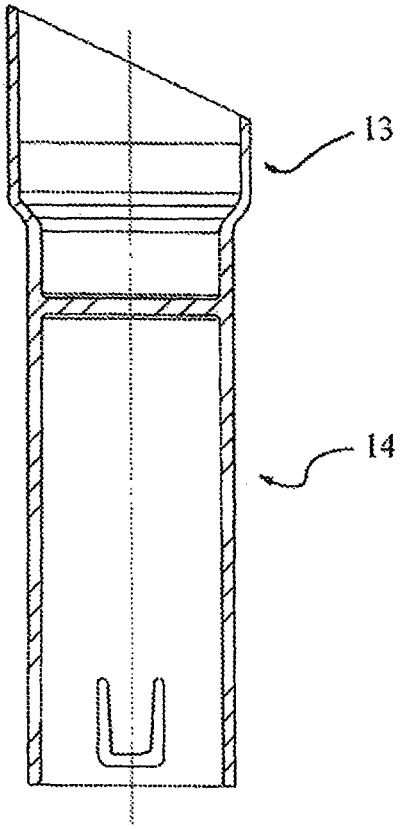
FIG. 13 is a section view along line B-B of FIG. 12.
Figure 12A:
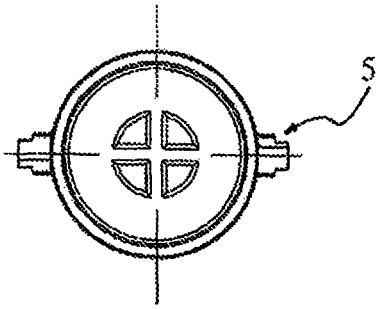
FIG. 12*a* is a section view along line C-C of FIG. 12.

According to the manner of embodiment illustrated in FIGS. 12 and 13, the specific structure of slider (2) makes it possible to insert a stick of lipstick by clamping, namely a positioning of the lipstick stick by the upper end of the slider, which becomes lodged inside a housing consisting of a bottom partition that comprises orifices for air evacuation.

According to the preceding manner of embodiment, the bottom partition of the housing designed to accommodate the stick of cosmetic product, is located in the upper part of the elongated cylindrical portion (14) of slider (2).

We note here that according to the manner of embodiment illustrated, the upper ends of slider (2) and of exterior sleeve (4) are beveled, but this could be otherwise, the upper end of slider (2) could be beveled, or even the upper ends of slider (2) and of exterior sleeve (4), can be straight.

Moreover, the more or less regular cylindrical shape of exterior sleeve (4), namely having a diameter that is more or less constant, makes it possible to round the upper end of this latter through a stamping process, and to obtain in this way an upper end of exterior sleeve (4) that is smooth to the touch, avoiding all presence of sharp edge areas, in particular in the case of a beveled end.

The invention claimed is:

1. A rotating mechanism (1) for a cosmetic case comprising a slider (2) including two studs (5), wherein each of said two studs crosses a helicoidal opening (6) of a spiral casing (3) pressed onto the slider (2), and wherein the studs (5) each extend into a longitudinal port (7) arranged inside an exterior sleeve (4) that is pressed onto the spiral casing (3), said slider (2) comprising two parts, said two parts comprising: (i) an upper end comprising a cradle (13) that is designed to receive a cosmetic product; and, (ii) an elongated cylindrical portion (14) connected to and extending downwardly from the cradle (13) and comprising a reduced outer diameter as compared to an outer diameter of said cradle (13), wherein the elongated cylindrical portion (14) of the slider (2) is slidably located within an interior diameter of the spiral casing (3) and the cradle (13) of the slider (2) is slidably located within an interior diameter of the exterior sleeve (4) but outside of said interior diameter of the spiral casing (3), and wherein the studs (5) are arranged at a lower end of said elongated cylindrical portion (14) spaced away from the cradle (13).

2. The rotating mechanism (1) according to claim 1, wherein the spiral casing (3) comprises a cylindrical body part (8) and wherein the helicoidal opening (6) comprises two helicoidal openings (6) arranged in said cylindrical body part (8) and said two studs (5) are respectively received in said two helicoidal openings (6), wherein the cylindrical body part (8) is extended by a crown (9).

3. The rotating mechanism (1) according to claim 2, wherein a lower end of the cylindrical body part (8) of the spiral casing (3) comprises at least one flexible slat (12) that extends towards an exterior.

4. The rotating mechanism (1) according to claim 2, wherein an upper part of crown (9) comprises a peripheral stop ring (15) that limits movement of the exterior sleeve (4).

5. The rotating mechanism (1) according to claim 2, wherein the studs (5) are moveable at least transversally.

6. The rotating mechanism (1) according to claim 2, wherein the reduced outer diameter of the elongated cylindrical portion (14) is approximately equal to but less than the interior diameter of the spiral casing (3), whereas the outer diameter of cradle (13) is approximately equal to but less than the interior diameter of exterior sleeve (4).

7. The rotating mechanism (1) according to claim 2, wherein the exterior sleeve (4) comprises an internal peripheral rib (10) that fits inside a peripheral groove (11) arranged in the spiral casing (3).

8. The rotating mechanism (1) according to claim 7, wherein the studs (5) are moveable at least transversally.

9. The rotating mechanism (1) according to claim 8, wherein a lower end of the cylindrical body part (8) of the spiral casing (3) comprises at least one flexible slat (12) that extends towards an exterior.

10. The rotating mechanism (1) according to claim 7, wherein the reduced outer diameter of the elongated cylindrical portion (14) approximately equal to but less than the interior diameter of the spiral casing (3), whereas the outer diameter of cradle (13) is approximately equal to but less than the interior diameter of exterior sleeve (4).

11. The rotating mechanism (1) according to claim 7, wherein the peripheral groove (11) is located below respective lower ends of the two helicoidal openings (6) that are arranged in the cylindrical body part (8) of spiral casing (3).

12. The rotating mechanism (1) according to claim 11, wherein the studs (5) are moveable at least transversally.

13. The rotating mechanism (1) according to claim 12, wherein a lower end of the cylindrical body part (8) of the spiral casing (3) comprises at least one flexible slat (12) that extends towards an exterior.

14. The rotating mechanism (1) according to claim 11, wherein the reduced outer diameter of the elongated cylindrical portion (14) is approximately equal to but less than the interior diameter of the spiral casing (3), whereas the outer diameter of cradle (13) is approximately equal to but less than the interior diameter of exterior sleeve (4).

15. The rotating mechanism (1) according to claim 1, wherein the studs (5) are moveable at least transversally.

16. The rotating mechanism (1) according to claim 15, wherein the reduced outer diameter of the elongated cylindrical portion (14) is approximately equal to but less than the interior diameter of the spiral casing (3), whereas the outer diameter of cradle (13) is approximately equal to but less than the interior diameter of exterior sleeve (4).

17. The rotating mechanism (1) according to claim 1, wherein the reduced outer diameter of the elongated cylindrical portion (14) of the slider (2) is approximately equal to but less than the interior diameter of the spiral casing (3), whereas the outer diameter of cradle (13) is approximately equal to but less than the interior diameter of the exterior sleeve (4).

18. The rotating mechanism (1) according to claim 1, wherein said rotating mechanism comprises three body parts including: (i) the slider (2), (ii) the spiral casing (3) and (iii) the exterior sleeve (4).

19. The rotating mechanism (1) according to claim 1, wherein the spiral casing (3) comprises an upper groove (17) assembled to an upper rib (18) that is arranged inside the exterior sleeve (4).

20. A rotating mechanism (1) for a cosmetic case comprising:

a spiral casing (3) defining an interior diameter and an outer diameter;

a slider (2) comprising two parts, said two parts including: (i) an upper part comprising a cradle (13) that is adapted to receive an associated cosmetic product, said cradle comprising an outer diameter that is larger than said interior diameter of said spiral casing (3); and, (ii) a lower part including an elongated cylindrical portion (14) connected to and extending downwardly away from the cradle (13), said elongated cylindrical portion (14) of said slider comprising a reduced outer diameter that is less than the outer diameter of the cradle (13), said elongated cylindrical portion (14) of said slider inserted into and movably located within said interior diameter of said spiral casing (3) and said cradle (13) located outside said interior diameter of the spiral casing (3), wherein said spiral casing (3) includes two helicoidal openings (6) and said lower elongated cylindrical portion (14) of said slider (2) includes two studs (5) that are spaced from said cradle (13) and that respectively extend through the two helicoidal openings of the spiral casing (3);

an exterior sleeve (4) located externally of said spiral casing (3) and including two longitudinally extending ports (7) into which the two studs (5) respectively extend, said exterior sleeve (4) comprising a sleeve interior diameter in which said outer diameter of said cradle is slidably received.

* * * * *